US008915297B2

(12) United States Patent
Surjaatmadja et al.

(10) Patent No.: US 8,915,297 B2
(45) Date of Patent: Dec. 23, 2014

(54) METHODS AND EQUIPMENT TO IMPROVE RELIABILITY OF PINPOINT STIMULATION OPERATIONS

(75) Inventors: Jim Basuki Surjaatmadja, Duncan, OK (US); Billy Wilson McDaniel, Duncan, OK (US); Loyd E. East, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 613 days.

(21) Appl. No.: 13/231,447

(22) Filed: Sep. 13, 2011

(65) Prior Publication Data

US 2013/0062077 A1 Mar. 14, 2013

(51) Int. Cl.
*E21B 33/134* (2006.01)
*E21B 43/267* (2006.01)
*E21B 33/127* (2006.01)

(52) U.S. Cl.
CPC ..... *E21B 43/267* (2013.01); *E21B 33/1277* (2013.01); *E21B 33/134* (2013.01)
USPC ..... 166/281; 166/192; 166/285

(58) Field of Classification Search
CPC ..... E21B 33/134; E21B 33/1208
USPC ..... 166/192, 281, 285
See application file for complete search history.

(56) References Cited

U.S. PATENT DOCUMENTS

| | | | | |
|---|---|---|---|---|
| 6,394,184 | B2 | 5/2002 | Tolman et al. | 166/281 |
| 7,225,869 | B2 | 6/2007 | Willett et al. | 166/280.1 |
| 7,766,083 | B2 | 8/2010 | Willett et al. | 166/308.1 |
| 7,878,247 | B2 * | 2/2011 | Misselbrook et al. | 166/298 |
| 8,668,011 | B2 * | 3/2014 | Mack et al. | 166/308.1 |
| 2005/0061520 | A1 | 3/2005 | Surjaatmadja et al. | |
| 2008/0271889 | A1 * | 11/2008 | Misselbrook et al. | 166/280.1 |
| 2009/0223667 | A1 | 9/2009 | Rispler | |
| 2010/0084137 | A1 * | 4/2010 | Surjaatmadja et al. | 166/373 |
| 2010/0175878 | A1 | 7/2010 | Rispler et al. | |

FOREIGN PATENT DOCUMENTS

| | | | |
|---|---|---|---|
| EP | 0851094 | A2 | 7/1998 |
| WO | 2005/090747 | A1 | 9/2005 |
| WO | 2010/037993 | A2 | 4/2010 |

OTHER PUBLICATIONS

International Search Report and Written Opinion issued in related International Application No. PCT/IB2012/055129, mailed Feb. 13, 2014, 17 pages.

Hejl et. al., "Extreme Multistage Fracturing Improves Vertical Coverage and Well Performance in the Lost Hills Field", SPE101840, Sep. 2006.

(Continued)

*Primary Examiner* — Giovanna Wright
(74) *Attorney, Agent, or Firm* — John W. Wustenberg; Baker Botts L.L.P.

(57) ABSTRACT

Apparatuses and methods for improving the reliability of pinpoint stimulation operations is disclosed. A pinpoint stimulation improvement apparatus is disclosed which includes a hold down device, at least one flow reducer coupled to the hold down device, and a jetting tool coupled to the flow reducer. The flow reducer is positioned downstream from the jetting tool. A fluid flowing through the jetting tool passes through the flow reducer and forms a sand plug downstream from the pinpoint stimulation improvement apparatus.

13 Claims, 6 Drawing Sheets

(56) References Cited

OTHER PUBLICATIONS

East et al., "Hydrajet Perforating and Proppant Plug Diversion in Multi-Interval Horizontal Well Fracture Stimulation: Case Histories", SPE 114881, Jun. 2008.

Thompson et al., "Operators Evaluate Various Stimulatin Methods for Multizone Stimulation of Horizontals in Northeast British Columbia", SPE 119620, Jan. 2009.

* cited by examiner

METHODS AND EQUIPMENT TO IMPROVE RELIABILITY OF PINPOINT STIMULATION OPERATIONS

BACKGROUND

The present invention relates to subterranean stimulation operations and, more particularly, to apparatuses and methods for improving the reliability of pinpoint stimulation operations.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing a casing or liner into place. Once the well bore is completed as desired (lined, cased, open hole, or any other known completion) a stimulation operation may be performed to enhance hydrocarbon production into the well bore. Where methods of the present invention reference "stimulation," that term refers to any stimulation technique known in the art for increasing production of desirable fluids from a subterranean formation adjacent to a portion of a well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

One suitable hydrajet stimulation method, introduced by Halliburton Energy Services, Inc., is known as the SURGIFRAC and is described in U.S. Pat. No. 5,765,642. The SURGIFRAC process may be particularly well suited for use along highly deviated portions of a well bore, where casing the well bore may be difficult and/or expensive. The SURGIFRAC hydrajetting technique makes possible the generation of one or more independent, single plane hydraulic fractures. Furthermore, even when highly deviated or horizontal wells are cased, hydrajetting the perforations and fractures in such wells generally results in a more effective fracturing method than using traditional perforation and fracturing techniques.

Another suitable hydrajet stimulation method, introduced by Halliburton Energy Services, Inc., is known as the COBRAMAX-H and is described in U.S. Pat. No. 7,225,869, which is incorporated herein by reference in its entirety. The COBRAMAX-H process may be particularly well suited for use along highly deviated portions of a well bore. The COBRAMAX-H technique makes possible the generation of one or more independent hydraulic fractures without the necessity of using mechanical tools to achieve zone isolation, can be used to perforate and fracture in a single down hole trip, and may eliminate the need to set mechanical plugs through the use of a proppant slug or wellbore fill.

Current pinpoint stimulation techniques suffer from a number of disadvantages. For instance, during hydrajetting operations, the movements of the hydrajetting tool generally reduces the tool performance. The movements of the hydrajetting tool may be caused by the elongation or shrinkage of the pipe or the tremendous turbulence around the tool. The reduction in tool performance is generally compensated by longer jetting times so that a hole is eventually created. However, the increase in jetting times leads to an inefficient and time consuming hydrajetting process.

The COBRAMAX-H process also suffers from some drawbacks. Specifically, the COBRAMAX-H process involves isolating the hydrajet stimulated zones from subsequent well operations. The primary sealing of the previous regions in the COBRAMAX-H process is achieved by placing sand plugs in the zones to be isolated. The placement of sand plugs, particularly in horizontal well bores, requires a very low flow rate which is difficult to achieve when using surface pumping equipment designed for high rate pumping operations. Moreover, when the operating pressures are high, the orifices of the tool must be very small to create a low flow rate. The small size of the orifices makes them susceptible to plugging.

Additionally, the placement of sand plugs in horizontal or substantially horizontal well bores may be difficult. Specifically, current methods of placement of sand dunes in horizontal well bores entail slowly pumping the sand down the well bore as shown in FIG. 1. An artificially low flow rate 2 is used to allow dropping of sand to the bottom side of the casing 4 to form a sand dune 6. To that end, the terminal velocity of the sand dropping down has to be faster than the flow velocity reaching the fracture point. However, this approach may prove ineffective. As shown in FIG. 1, as a sand dune 6 is created, the area above the dune becomes smaller, thereby increasing the flow velocity over the sand dune 6. The increased flow velocity destroys the top of the sand dune 6. As a result, the flow that passes on top of the sand dune 6 may enter the fracture 8 and further open it.

Finally, the SURGIFRAC process which uses the Bernoulli principle to achieve sealing between fractures poses certain challenges. During the SURGIFRAC process, the primary flow goes to the fracture while the secondary, leakoff flow, is supplied by the annulus. In some instances, such as in long horizontal well bores, a large number of fractures may be desired. The formation of each fracture results in some additional leakoff (i.e., seepage). Consequently, with the increase in the number of fractures, the amount of the secondary leakoff flow increases and eventually can significantly reduce the amount of the primary flow to the new fracture. The increased fluid losses reduce the efficiency of the operations and increases the cost. Accordingly, a flow limiter device is desirable to reduce annulus flow requirements while maintaining pore-pressure and limited flow influx to previous fractures below the new fracture, and after pumping has ceased, to let the new fracture slowly close without producing proppant.

SUMMARY

The present invention relates to subterranean stimulation operations and, more particularly, to apparatuses and methods for improving the reliability of pinpoint stimulation operations.

In one exemplary embodiment, the present invention is directed to a pinpoint stimulation improvement apparatus comprising: a hold down device; at least one flow reducer coupled to the hold down device; and a jetting tool coupled to the flow reducer. The flow reducer is positioned downstream from the jetting tool and the fluid flowing through the jetting tool passes through the flow reducer and forms a sand plug downstream from the pinpoint stimulation improvement apparatus.

In another exemplary embodiment, the present invention is directed to a method of creating a sand plug at a fracture in a wellbore having a fracture opening comprising the steps of: flowing a sand slurry to the fracture opening at a low flow rate; creating a sand dune proximate to the fracture opening; flowing the sand slurry into an upper portion of the fracture; allowing sand particles to drop down into the wellbore; depositing sand particles on the sand dune; and substantially plugging the fracture opening.

In yet another exemplary embodiment, the present invention is directed to a method of creating a sand plug in a well bore in a subterranean formation comprising: directing a high pressure fluid downhole through a pinpoint stimulation improvement apparatus comprising a jetting tool, a hold down device and a flow reducer; flowing the high pressure fluid through the jetting tool; reducing pressure of the high pressure fluid to obtain a low pressure fluid; wherein the pressure of the high pressure fluid is reduced by flowing the high pressure fluid through the flow reducer, wherein the flow reducer is positioned downstream from the jetting tool; discharging the high pressure fluid with the reduced pressure from the pinpoint stimulation improvement apparatus through an outlet of the flow reducer; and depositing solid materials into the well bore downhole from the pinpoint stimulation improvement apparatus.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates to subterranean stimulation operations and, more particularly, to apparatuses and methods for improving the reliability of pinpoint stimulation operations.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection via other devices and connections. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

Figure 1:
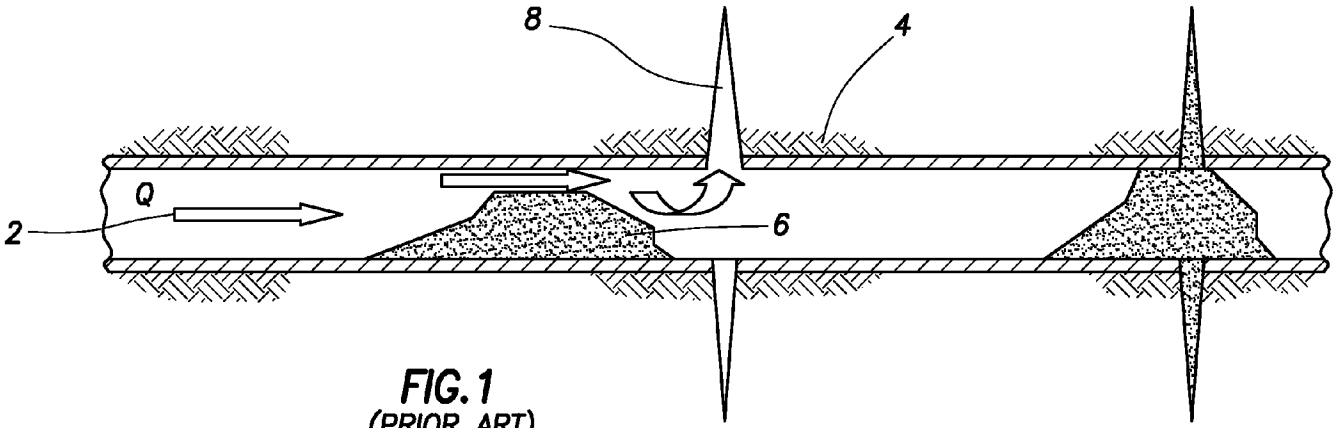
FIG. 1 (PRIOR ART)
FIG. 1 depicts a cross-sectional view of placement of sand dunes in a horizontal well in accordance with the Prior Art.
Figure 2:
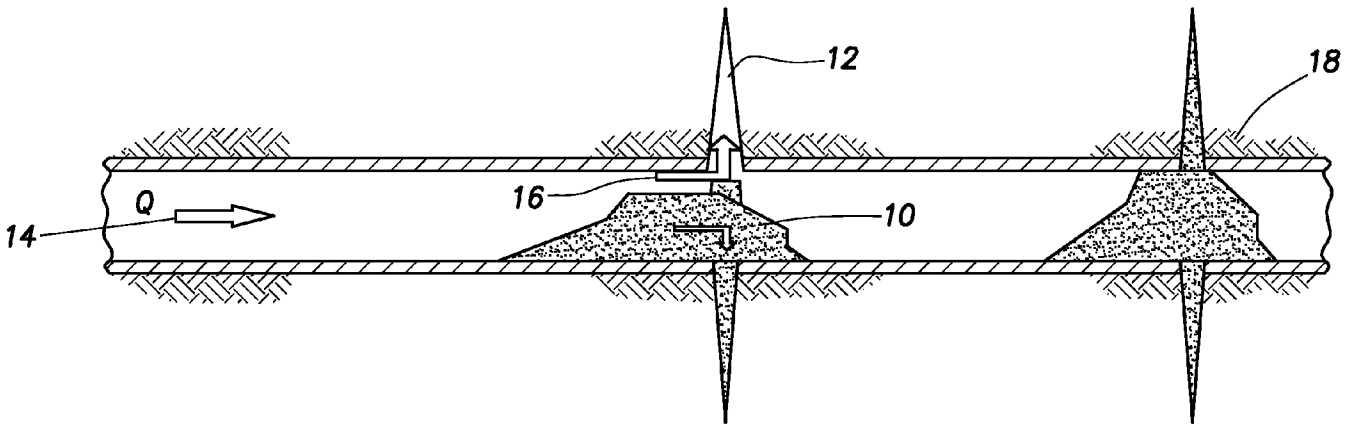
FIG. 2 depicts a cross-sectional view of placement of sand dunes in a horizontal well in accordance with an exemplary embodiment of the present invention.

Turning now to FIG. 2, placement of a sand dune in accordance with an exemplary embodiment of the present invention is depicted. The manner of placement of the sand dune 10 is dependent upon the terminal velocity of the dropping particles, particularly in the fracture 12 or to the ability to pack-off the near-wellbore area. In accordance with an exemplary embodiment of the present invention, the particle terminal velocity is reflected as the ability of the particle to fall inside the fracture 12. FIG. 2 depicts a perspective view of the particles dropping in the fracture 12 in accordance with an exemplary embodiment of the present invention.

Figure 3:
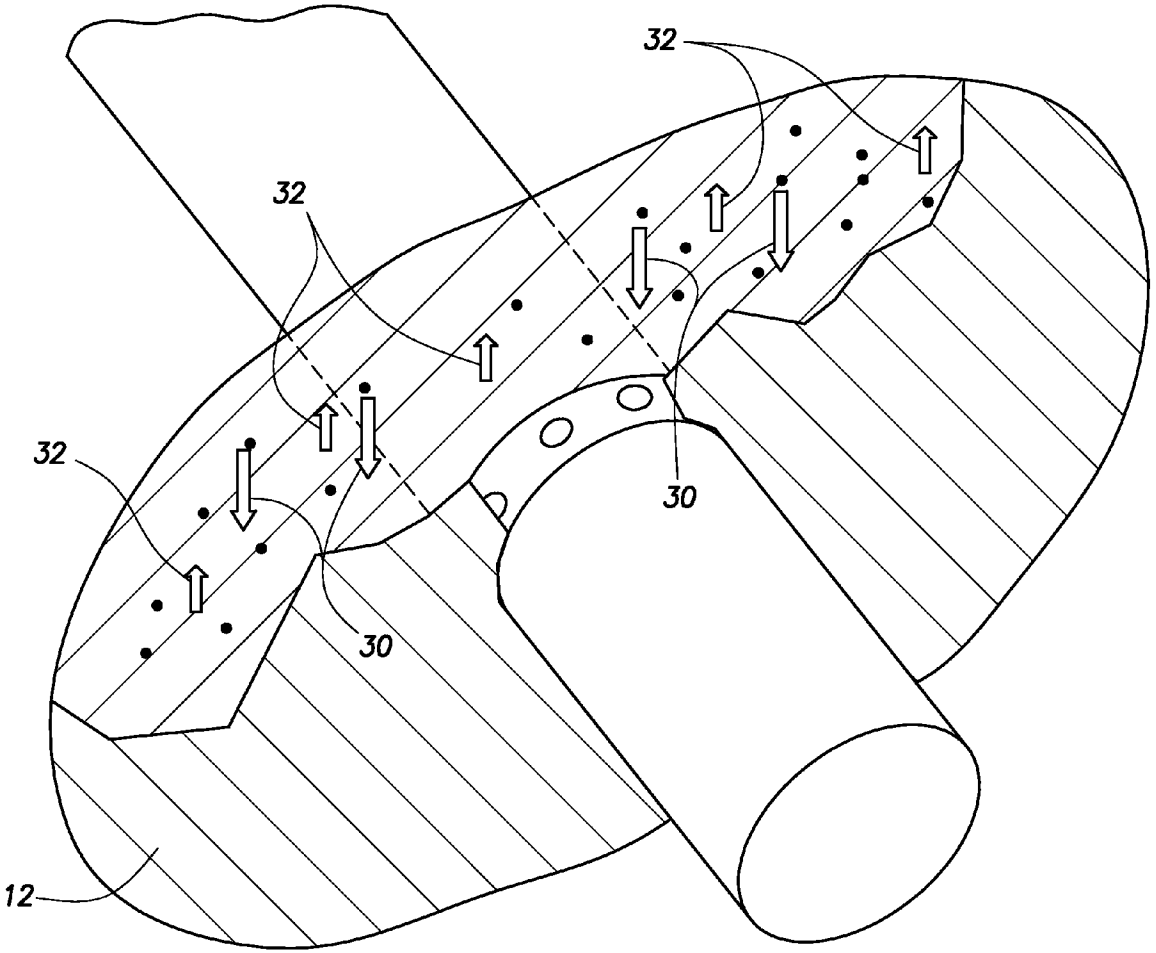
FIG. 3 depicts a perspective view of sand plug formation in accordance with an exemplary embodiment of the present invention.

As shown in FIGS. 2 and 3, it may be assumed that the proppants in the fracturing fluid mostly drop on the bottom surface of the casing 18. Although the present methods and systems are discussed in conjunction with a casing, as would be appreciated by those of ordinary skill in the art, with the benefit of this disclosure, the methods and systems disclosed herein are also applicable to well bores that do not include a casing. As proppants drop in the borehole, a small sand dune 10 begins to develop around the fracture 12 as shown in FIG. 2. As shown in FIG. 3, as the sand dune 10 is developed, sand will fall into portions of the fracture 12, which in FIG. 3 is depicted as extending into the formation along the circumference of the casing 18. The creation of a sand plug is then performed by pumping a slow flowing proppant slurry downhole into the borehole as depicted by arrow 14. Part of the proppant slurry 14 may be lost into the bottom portion of the fracture 12 and the casing 18 as the sand dune 10 develops. In contrast, part of the proppant slurry may flow into the top side of the fracture 12 as shown by arrow 16.

In order to successfully create an effective sand plug, the downward proppant terminal velocity 30 inside the fracture 12 has to be higher than the upward leak off velocity 32 upwards in the fracture 12 which results in particles settling inside the fracture 12 on the top side of the casing 18. This ensures the creation of a stable proppant plug in the casing 18. Alternately, due to the restricted flow rate the fracture below the hold-down will be closing and becoming packed with proppant or very narrow in the areas not fully propped. If the sand grains do not fall back even at this reduced flow velocity the sand plug in the wellbore can form if proppant can be carried into the near wellbore portion of the fracture and achieve a packed area, such that fluid cannot enter the main body of the fracture without having to seep though this proppant pack. If this process does not further reduce the flow such that the grains do not fall back downward as described above, they will soon completely fill any remaining void area until ultimately this pack-off has grown into the wellbore itself, substantially plugging off the fracture opening and forming a solid mass inside the wellbore until it is completely filled. Once completely filled, any fluid flow into the fracture has to seep through this entire wellbore mass and the packed near-wellbore fracture area. If any flow carrying proppant later occurs it will only serve to enlarge the volume of the wellbore plug with this plug growth toward the heel of the lateral.

As would be appreciated by those of ordinary skill in the art, with the benefit of this disclosure, placement of sand plugs in accordance with embodiments disclosed herein requires a very low flow rate that is typically hard to control using surface pumping equipment designed for high rate pumping. One solution is to provide a low flow rate downhole in conjunction with performing hydrajetting operations. However, the hydrajet tools or other tools used downhole utilize high pressures. Therefore, small orifices may be required in order to create very low flow rates. However, such small orifices are susceptible to plugging. Accordingly, in order to perform the methods disclosed herein, a system must be used that can produce low flow rates without plugging the orifices of the tool downhole, such as the hydrajetting tool.

Figure 4:
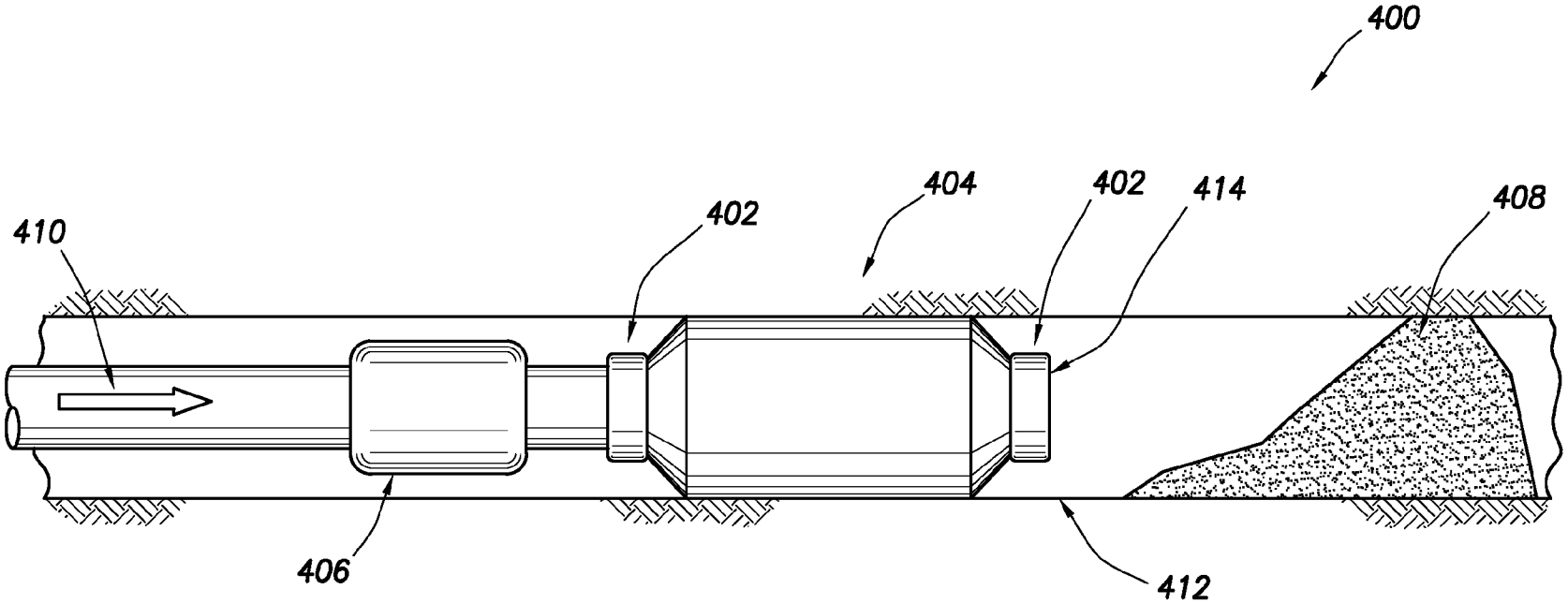
FIG. 4 depicts a simplified Pinpoint Stimulation Improvement Apparatus in accordance with an exemplary embodiment of the present invention.

In accordance with an exemplary embodiment of the present invention, successful placement of sand plugs in the well bore may entail creation of a hold-down mechanism for a stimulation system such as, for example, a hydrajetting system such as SurgiFract/CobraMax as discussed above. FIG. 4 depicts a simplified Pinpoint Stimulation Improvement Apparatus (PSIA), denoted generally with reference numeral 400, that may be used to perform the methods disclosed herein. As shown in FIG. 4, the PSIA 400 may include one or more flow reducers 402, a mechanical hold down device 404 which may regulate fluid flow through the well bore by blocking off upstream flow from the flow reducer 402 outlet (in FIG. 4, from the flow reducer 402 to the left), and a stimulation jetting tool 406. In one exemplary embodiment, the stimulation jetting tool 406 may be a hydrajetting tool and/or the hold down device 404 may be a packer or an inflatable element. In one exemplary embodiment, the PSIA 400 may allow a low flow rate, but greatly reduce the high pressure required by the jetting tool itself before fluid is discharged from the flow reducer 402. The low pressure fluid discharged from the flow reducer 402 may then form a sand plug 408. Specifically, as shown in FIG. 4, a high pressure fluid 410 is directed downhole and flows downstream through the PSIA 400. The high pressure fluid 410 then may pass through the jetting tool 406 and flow downhole through at least one flow reducer 402 before exiting the PSIA 400. In one embodiment, the PSIA 400 may include two flow reducers 402 located uphole and downhole, respectively, relative to the mechanical hold down device 404 with the mechanical hold down device 404 located there between. Accordingly, the high pressure fluid 410 passes through one or more flow reducers 402 before exiting the PSIA 400 and forming a sand plug 408 downhole from the PSIA 400 and the jetting tool 406.

As would be appreciated by those of ordinary skill in the art, with the benefit of this disclosure, in order to create the sand plug 408, the high pressure fluid flowing through the PSIA 400 is laden with suitable solid materials. As the high pressure fluid 410 passes through the one or more flow reducers 402, its pressure will be reduced, turning it into a low pressure fluid. Once the low pressure fluid passes through the flow reducer 402, it may be discharged from the PSIA 400 through an outlet 414. Upon discharge from the PSIA 400, the solid materials included therein will be deposited into the well bore 412 at the desired location downhole from the PSIA 400, forming a sand plug 408.

Although FIG. 4 depicts a flow reducer 402 which appears to include a simple choke, as would be appreciated by those of ordinary skill in the art, with the benefit of this disclosure, a simple choking device is not best suited for performing the methods disclosed herein. Specifically, a simple choke would require very small opening, for example, 0.5 BPM through it at pressure differentials of 5000 psi. However, achieving 5000 psi pressure differential may require 0.1" nozzle opening. Such a small opening will be prone to being plugged by debris or the sand slurry used in the jetting process. Accordingly, the flow reducers 402 used in the PSIA 400 must be designed to address these issues. As discussed in more detail below, a flow reducer 402 may be designed in accordance with an exemplary embodiment of the present invention.

Figure 5:
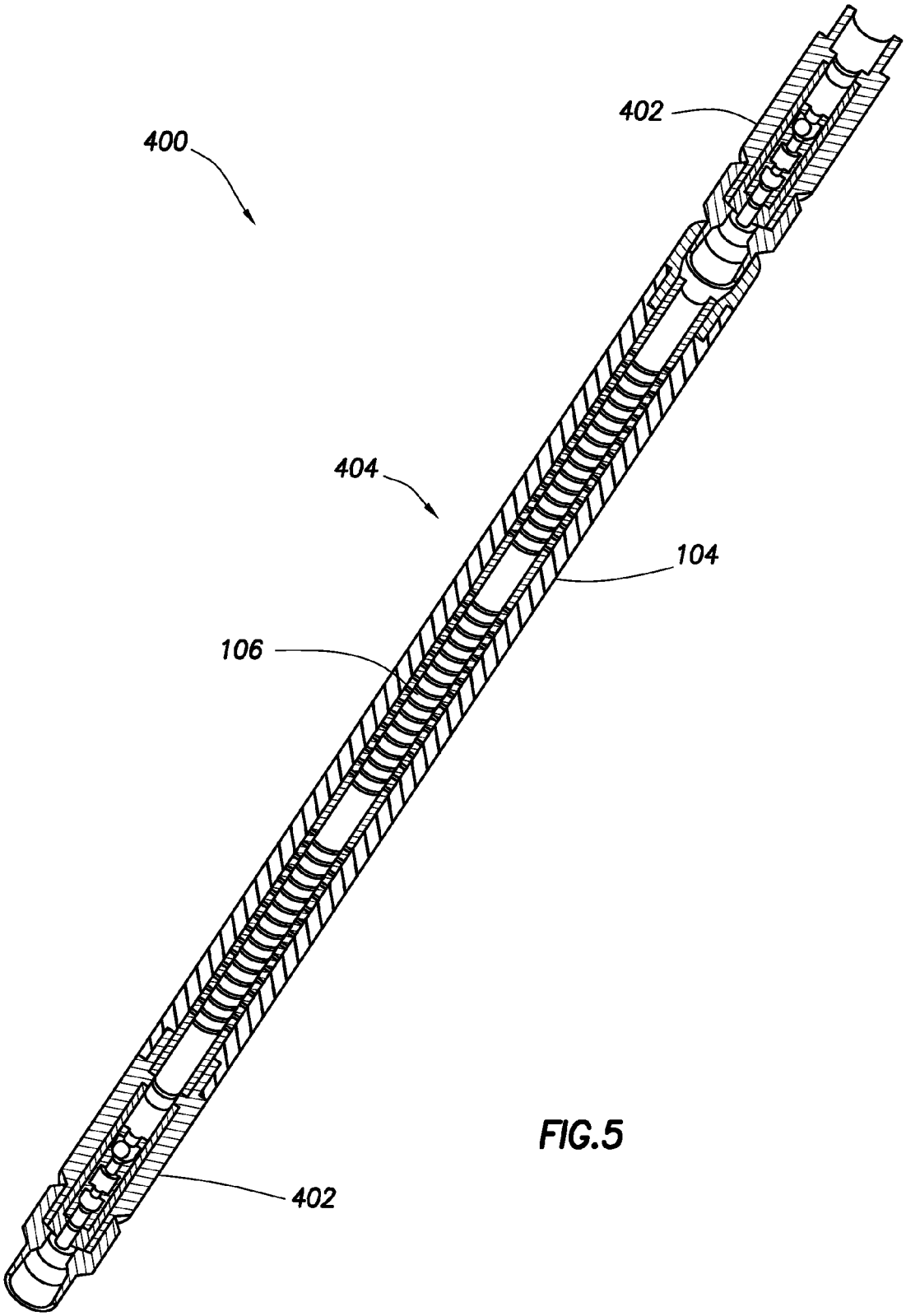
FIG. 5 is a perspective view of a Pinpoint Stimulation Improvement Apparatus in accordance with an exemplary embodiment of the present invention.

Turning now to FIG. 5, a cross-sectional view of a portion of the PSIA 400 of FIG. 4, in accordance with an exemplary embodiment of the present invention, is depicted. The portion of the PSIA 400 depicted in FIG. 5 includes the two flow reducers 402 and the mechanical hold down device 404. The PSIA 400 may comprise one or more flow reducers 402, and a mechanical hold down device 404. The mechanical hold down device 404 may include an elastomeric element 104 and a spring-mandrel 106 placed on the inner surface of the elastomeric element 104. The spring-mandrel 106 is stiff and provides some flexure, while acting as a resetting mechanism to the elastomeric element 104. Additionally, the spring-mandrel 106 provides a free flow between the area behind and inside the mandrel. In one exemplary embodiment, "blanked" areas may be placed strategically to allow installation of chokes to promote flow through the outside section of the spring-mandrel 106, thereby continuously clearing the area from sand or proppants. Specifically, chokes may be placed a few places (such as at the blanked sections) to insure that a portion of the flow always goes through the outside of the spring-mandrel 106 and hence, that no sand or proppants are trapped in the elastomeric cavity.

Figure 6A:
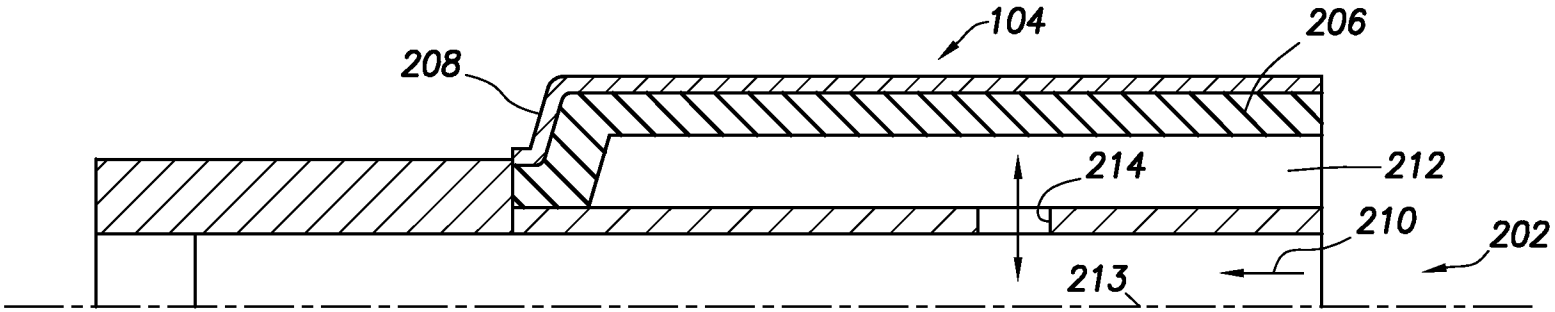
FIGS. 6A and 6B depict a cross-sectional comparison of a traditional packer configuration (FIG. 6A) and an inflatable packer with a hold down implementation of a Pinpoint Stimulation Improvement Apparatus (FIG. 6B) in accordance with an exemplary embodiment of the present invention.
Figure 6B:
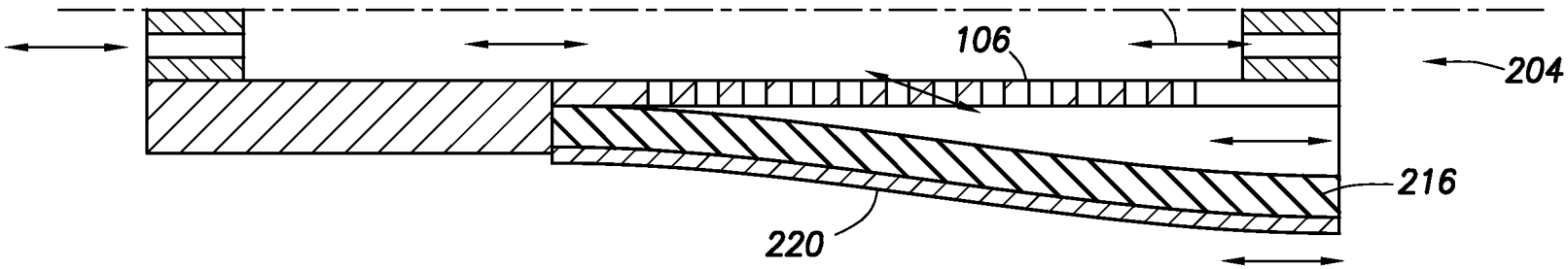

The elastomeric element 104 may perform as a hold down device. FIGS. 6A and 6B depict a cross sectional comparison of an elastomeric element used as an inflatable packer configuration (in accordance with the prior art) with the elastomeric element hold down configuration in accordance with an exemplary embodiment of the present invention. Specifically, FIG. 6A depicts the traditional packer implementation 202 and FIG. 6B depicts the new hold down configuration 204. In the packer implementation 202 the elastomeric element 206 is pressurized such that a total seal occurs between the top and bottom (right and left of FIGS. 6A and 6B) of the packer. The pressure achieved must be high enough so that the elastomeric element 206 is completely deformed, forming a competent seal. The slats 208 in the packer implementation 202 can become permanently deformed, with the deformation becoming more pronounced after each cycle. The pressurization of the packer implementation 202 may be achieved using a clean fluid 210. The clean fluid 210 is placed in the cavity 212 through the cavity opening 214 and the cavity opening 214 is closed, leaving the packer set. To unset the packer, the cavity opening 214 must be manually opened.

In contrast, with the hold down implementation 204, the elastomeric element 216 may be pressurized by a process fluid 213 such as a sand slurry or an acid, often containing sand or other particles. The pressure of the process fluid 213 is pro-rated using a pressure reduction system, discussed in more detail below. Because the pressure is pro-rated, the low pressure of the process fluid 213 inflates the elastomeric element 216 just enough to touch the outside walls (not shown), without causing a complete seal. Sealing is not the primary object of the hold down implementation and unlike the packer implementation, fluid flow remains continuous through the tool, as well as possibly around the tool, from the top to the bottom (from right to left in FIGS. 6A and 6B) of the tool. Moreover, in the hold down implementation, the elastomeric element 216 is not deformed. The elastomeric element 216 is strengthened and protected by slats 220 which are either outside of the elastomeric element 216 or covered within it (not shown). The outer slats 220 are stretched by the spring-mandrel 106. As a result, the elastomeric element 216 deflates as soon as the process fluid 213 ceases to be pumped through the tool, or the flow rate becomes too low to create adequate pressure as it flows through the flow reducer 402 at this very low rate. Thus, the hold down capabilities of the PSIA 400 perform as an anchoring mechanism allowing the tool to be maintained at a fixed position for a desired period before deflating and allowing it to move to a second desired location. As the elastomeric element 216 deflates, the spring-mandrel 106 collapses the elastomeric element 216 back in position and the PSIA 400 is dislodged from its location.

In one embodiment, the PSIA 400 in accordance with an exemplary embodiment of the present invention may be utilized to improve the performance of a hydrajetting tool. Specifically, the tool movements due to pipe elongation/shrinkage, temperature and/or pressure can be minimized by engaging the hold down implementation of the PSIA 400. As would be appreciated by those of ordinary skill in the art, with the benefit of this disclosure, the strength requirements for the hold-down device are minimal. For instance, in a vertical well, a 4000 ft. tubing, 2⅜" outside diameter—4.7 lb./ft. would only need 3800 lbs. of elongation force to stretch a full 1 ft.; or about 319 lb./in., if it was not somewhat restrained by the casing above it. As would be appreciated by those of ordinary skill in the art, with the benefit of this disclosure, in reality, this value will have to be subtracted by some large unknown value, representing friction with the wellbore wall. Note that, even in "vertical" wells, wells are never truly vertical; some slants occur during the drilling of the well. In horizontal wells, movement can sometimes be large due to the "jerkiness" of the system. However, the pipe friction negates some of this movement. For instance, for a 2000 ft. tubing as in the above example, in a horizontal well, assuming a friction factor of 0.35 between the pipe and the well bore wall, the friction force may be close to 3290 lbs, thus needing an additional help of only 500 lbs to prevent the tool's movement. Similarly, the jet reaction force causes some small side movements of the tool. For instance, a 0.25" jet at a pressure of 5000 psi may produce a 400 lb. thrust acting as a downward piston force. Consequently, some small additional force will suffice in preventing the movements of a hydrajetting tool during operation. When in the hold down implementation, the PSIA 400 provides a flexible, elastomeric hold down system which minimizes the tool movements and improves the efficiency of the hydrajetting process.

Figure 7:
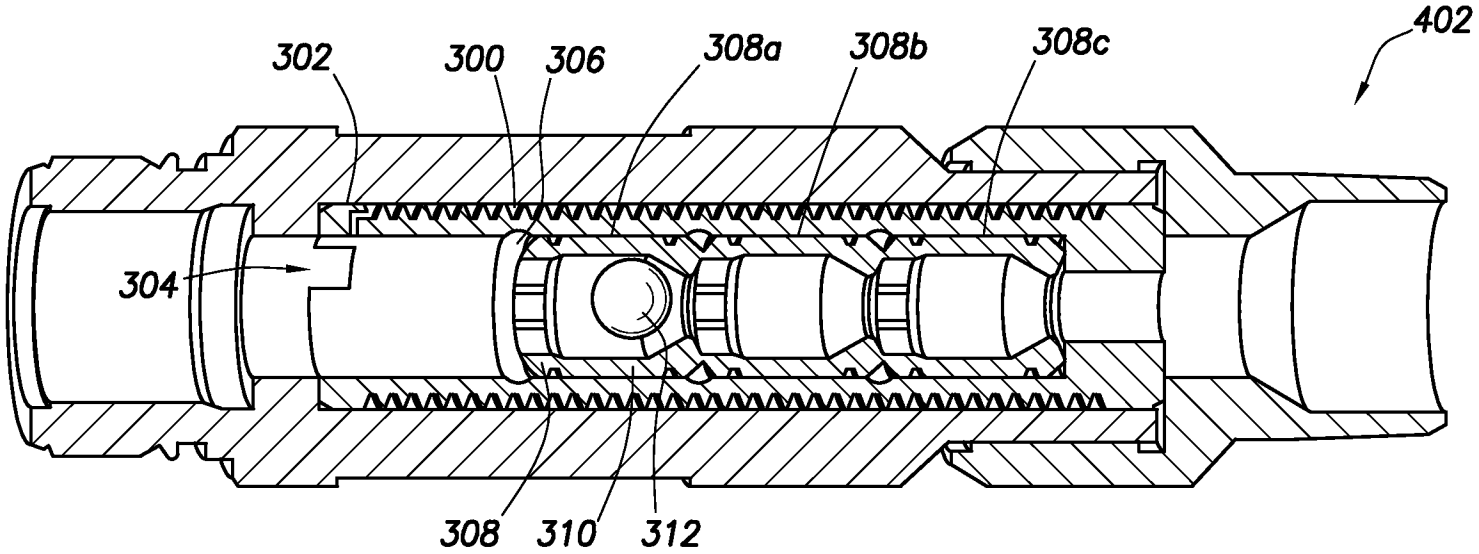
FIG. 7 is a flow limiter used in a Pinpoint Stimulation Improvement Apparatus in accordance with an exemplary embodiment of the present invention.

As depicted in FIGS. 4 and 5, the PSIA 400 may include one or more flow reducers 402. FIG. 7 depicts a flow reducer 402 in accordance with an exemplary embodiment of the present invention. As depicted in FIG. 7, the fluid may be routed through a pressure reducing channel 300, which wraps around the outer surface of the inner tubing 302 a multitude of times. The fluid enters the pressure reducing channel through the inlet 304. The friction pressure drop due to the continuous turn becomes very high, even though the channel size is quite big. As the fluid flows through the pressure reducing channel 300, the fluid flow rate is also reduced. The fluid, now having a lower flow rate, then exits the pressure reducing channel 300 through an outlet (not shown) and flows back into the inside of the inner tubing 302. In one exemplary embodiment, as depicted in FIG. 7, the channel may be intercepted at three points (e.g., 306), thus bypassing a portion of the channel for pressure control.

As depicted in FIG. 7, in one exemplary embodiment, the flow reducer 402 may further comprise one or more pressure control modules 308*a*, 308*b*, and 308*c*. In one embodiment, the pressure control modules 308*a*, 308*b*, and 308*c* may be ball seat arrangements. The ball seat arrangement includes a seat body 310. The seat body 310 is arranged so that it can be sealed within the flow reducer 402. A ball 312 may be inserted into the seat body 310 through an opening (not shown). Once the ball 312 is inserted into the seat body 310, it is caged therein. Although FIG. 7 depicts three ball seat modules 308*a*, 308*b*, and 308*c*, as would be appreciated by those of ordinary skill in the art, with the benefit of this disclosure, a different number of ball seat modules may be utilized. Each ball seat module 308 bypasses a portion of the pressure reducing channel 300 through ports located just above each potential ball seat module position. These ports connect the channel 300 to the inside of the inner tubing. Although the pressure control modules 308 are discussed in conjunction with the flow reducer 402, as would be appreciated by those of ordinary skill in the art, with the benefit of this disclosure, the pressure control modules 308 may be used independently as a general purpose check valve.

In one exemplary embodiment, the ball seat arrangement of the pressure control modules 308*a*, 308*b*, and 308*c* may also perform as a check valve. Specifically, the ball seat arrangement may permit fluid flow from the bottom to the top of the PSIA 400 of FIG. 7 for cleaning purposes. Moreover, the ball seat modules 308 may provide a high flow rate return line for the fluids that are pumped down the annulus while maintaining a low flow rate for the fluids being pumped down through the PSIA 400.

In one embodiment, it may be desirable to control the pressure of the fluid flowing through the elastomeric element. In one exemplary embodiment, two or more flow reducers 402 may be used as shown in FIG. 5. The pressure control units may be set with multiple combinations so that the intended pressure and flow is reached.

In one embodiment, the present invention may be utilized in conjunction with the COBRAMAX-H process where the creation of solid sand plugs are required for the process. This sand plug creation depends upon the ability to pump sand slurries at a very low flow rate. Typically, the high pressure of the fluids results in a high flow rate. The flow reducer 402 may be used to reduce the flow rate to as low as 1/2 bpm (barrels per minute) without using extra small chokes that would tend to plug when exposed to sand. Therefore, the PSIA 400 allows the placement of competent sand plugs at desired locations. To achieve a similar result using conventional chokes, a 0.09" choke must be utilized which would potentially plug with sand that is 30 Mesh or greater. Although a flow reducer 402 in accordance with an exemplary embodiment of the present invention has some size limitations, it can be designed to accept 8 Mesh or even larger particles.

In another exemplary embodiment, the present invention may be used in conjunction with SURGIFRAC operations. Specifically, once a first fracture is created during the SURGIFRAC operations, the hydrajetting tool is moved to a second location to create a second fracture. However, some of the fluids that are being pumped into the annulus will leakoff into the already existing fracture. As the number of fractures increases, the amount of fluid that leaks off also increases. The hold down implementation of the PSIA 400 reduces the amount of leak off fluid flow through the annulus from the hydrajetting tool (not shown) to the existing fractures. Specifically, as the elastomeric element 206 inflates, it restricts the path of the leak of fluid flow, thereby reducing the amount of fluids leaked off. Consequently, the PSIA 400 will reduce the annulus flow requirement while maintaining pore-pressure and limited flow influx to let the fracture slowly close without producing proppants back into the wellbore after fluid injection has stopped.

As would be appreciated by those of ordinary skill in the art, with the benefit of this disclosure, the term "pinpoint stimulation" is not limited to a particular dimension. For instance, depending on the zones to be isolated, the area subject to the "pinpoint stimulation" may be a few inches or in the order of tens of feet in size. Moreover, although the present invention is disclosed in the context of "stimulation" processes, as would be appreciated by those of ordinary skill in the art, the apparatuses and methods disclosed herein may be used in conjunction with other operations. For instance, the apparatuses and methods disclosed herein may be used for non-stimulation processes such as cementing; in particular squeeze cementing or other squeeze applications of chemicals, fluids, or foams.

As would be appreciated by those of ordinary skill in the art, although the present invention is described in conjunction with a hydrajetting tool, it may be utilized with any stimulation jetting tool where it would be desirable to minimize tool movement and/or fluid leak off. Moreover, as would be appreciated by those of ordinary skill in the art, with the benefit of this disclosure, any references to the term "sand" may include not only quartz sand, but also other proppant agents and granular solids. Additionally, as would be appreciated by those of ordinary skill in the art, with the benefit of this disclosure, although the present invention is described as using one PSIA, two or more PSIAs may be used simultaneously or sequentially in the same application to obtain desired results, without departing from the scope of the present invention.

As would be apparent to those of ordinary skill in the art, with the benefit of this disclosure, a flow reducer 402 in accordance with an embodiment of the present invention may be used to achieve a pressure drop of 1000 psig or more, which is typically not achievable using a simple choke.

Accordingly, a PSIA in accordance with an exemplary embodiment of the present invention may be used to create sand plugs at a fracture in a wellbore to substantially plug the fracture opening. The flow rate of the sand slurry may be reduced to a desired rate using a PSIA as described in detail above. The low flow rate sand slurry may then be discharged into the well bore at a desired location, such as the opening of a fracture that is to be plugged. As the sand slurry is discharged, a sand dune is created proximate to the fracture opening. A portion of the sand slurry flows into an upper portion of the fracture and sand particles are dropped down into the wellbore. As sand particles are deposited onto the sand dune, the sand dune becomes larger until it substantially plugs the fracture opening. As would be appreciated by those of ordinary skill in the art, with the benefit of this disclosure, because of the low flow rate of the sand slurry, the sand dune is not disturbed as the sand slurry flows to the fracture opening. Alternately, due to the restricted flow rate the fracture below the hold-down will be closing and becoming packed with proppant or very narrow in the areas not fully propped such that if the sand grains do not fall back even at this reduced flow velocity they will ultimately pack off the near-wellbore part of the fracture and this pack will either cause flow to become so low that the grains now fall or will completely fill this fracture area and the pack will grow into the wellbore and complete the wellbore packoff and build a complete wellbore sand plug.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method of creating a sand plug at a fracture in a wellbore having a fracture opening comprising the steps of:

flowing a sand slurry to the fracture opening at a low flow rate;

creating a sand dune at the fracture opening;

flowing the sand slurry into an upper portion of the fracture;

allowing sand particles of the sand slurry to drop down into the wellbore from the upper portion of the fracture;

depositing the sand particles on the sand dune; and substantially plugging the fracture opening.

2. The method of claim 1, wherein the low flow rate of the sand slurry leaves the sand dune substantially undisturbed.

3. The method of claim 1, wherein flowing the sand slurry to the fracture opening at a low flow rate comprises flowing the sand slurry through a pinpoint stimulation improvement apparatus.

4. The method of claim 3, wherein the pinpoint stimulation apparatus comprises:

a mechanical hold down device;

wherein the mechanical hold down device regulates fluid flow through a well bore;

a jetting tool positioned uphole from the mechanical hold down device; and at least one flow reducer positioned downhole from the jetting tool;

wherein the flow reducer reduces pressure of a fluid flowing through the pinpoint stimulation improvement apparatus;

wherein the fluid exits the pin point stimulation apparatus through an outlet of the flow reducer positioned downhole from the jetting tool.

5. The method of claim 4, wherein the flow reducer comprises a pressure control module.

6. The method of claim 4, wherein the flow reducer comprises:

an inner tubing;

a pressure reducing channel on an outer surface of the inner tubing;

an inlet from the inside of the inner tubing to the pressure reducing channel; and an outlet from the pressure reducing channel to the inside of the inner tubing.

7. The method of claim 4, wherein the at least one flow reducer comprises a first flow reducer positioned uphole from the mechanical hold down device and a second flow reducer positioned downhole from the mechanical hold down device.

8. The method of claim 4, wherein the mechanical hold down device is coupled to the flow reducer and wherein the mechanical hold down device comprises:

an elastomeric element; and a spring positioned on an inner surface of the elastomeric element;

wherein the elastomeric element expands to form a hold down mechanism for the pinpoint stimulation improvement apparatus.

9. The method of claim 1, wherein allowing sand particles to drop down into the wellbore comprises:

allowing sand particles to pack-off in a narrow portion of the fracture near wellbore;

wherein allowing sand particles to pack-off in a narrow portion of the fracture near wellbore reduces the flow rate; and allowing the sand particles to drop down into the well bore after the flow rate is reduced.

10. The method of claim 1, wherein allowing sand particles to drop down into the wellbore comprises allowing sand particles to pack-off in a narrow portion of the fracture near the wellbore; reducing the flow rate of the sand slurry; substantially filling the fracture near the wellbore; growing the pack back into the wellbore; and substantially plugging off the fracture opening.

11. The method of claim 1, wherein flowing the sand slurry to the fracture opening at the low flow rate comprises:

directing the sand slurry at a high pressure downhole through a pinpoint stimulation improvement apparatus comprising a jetting tool, a hold down device and a flow reducer;

flowing the high pressure sand slurry through the jetting tool;

reducing pressure of the high pressure sand slurry to obtain a low pressure sand slurry; wherein the pressure of the high pressure sand slurry is reduced by flowing the high pressure sand slurry through the flow reducer, wherein the flow reducer is positioned downstream from the jetting tool;

discharging the low pressure sand slurry; from the pinpoint stimulation improvement apparatus through an outlet of the flow reducer; and directing the low pressure fluid to the fracture opening;

wherein the sand dune is created in the well bore downhole from the pinpoint stimulation improvement apparatus.

12. The method of claim 11, wherein the flow reducer further comprises a pressure control module comprising:

a seat body, wherein the seat body may be sealed within an outer body;

an opening on the seat body; and a ball, wherein the ball is inserted in to the seat body through the opening.

13. The method of claim 11, wherein the flow reducer comprises:

an inner tubing;

a pressure reducing channel on an outer surface of the inner tubing;

an inlet from the inside of the inner tubing to the pressure reducing channel; and an outlet from the pressure reducing channel to the inside of the inner tubing.

* * * * *